US010935934B2

(12) United States Patent
Maire et al.

(10) Patent No.: US 10,935,934 B2
(45) Date of Patent: Mar. 2, 2021

(54) BAR PROVIDED WITH TWO RETRACTABLE PIVOTS FOR SECURING A WRISTLET ON A WATCH

(71) Applicant: The Swatch Group Research and Development Ltd, Marin (CH)

(72) Inventors: Francois Maire, Bienne (CH); Jean-Marc Von Allmen, St-Blaise (CH); Jonathan Vonlanthen, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 59 days.

(21) Appl. No.: 16/372,796

(22) Filed: Apr. 2, 2019

(65) Prior Publication Data

US 2019/0324403 A1 Oct. 24, 2019

(30) Foreign Application Priority Data

Apr. 23, 2018 (EP) ..... 18168777

(51) Int. Cl.
*A44C 5/14* (2006.01)
*G04B 37/14* (2006.01)

(52) U.S. Cl.
CPC ..... *G04B 37/1493* (2013.01); *A44C 5/14* (2013.01)

(58) Field of Classification Search
CPC ..... G04B 37/1493; A44C 5/14
See application file for complete search history.

(56) References Cited

U.S. PATENT DOCUMENTS 2,076,918 A * 4/1937 Robison ..... F16L 37/248 285/82
2,820,655 A * 1/1958 Hileman ..... F16B 7/20 403/349

(Continued)

FOREIGN PATENT DOCUMENTS

| | | |
|---|---|---|
| CH | 327838 | 2/1958 |
| DE | 20 2010 013 569 U1 | 3/2011 |
| EP | 0 089 166 | 9/1983 |

OTHER PUBLICATIONS

European Search Report dated Nov. 20, 2018 in European Application 18168777.3 filed on Apr. 23, 2018 (with English translation of categories of Cited Documents).

(Continued)

*Primary Examiner* — Jason W San
(74) *Attorney, Agent, or Firm* — Oblon, McClelland, Maier & Neustadt, L.L.P.

(57) ABSTRACT

A bar for securing a watch wristlet including a hollow inner tube arranged in the hollow body, and is configured to co-operate with the first pivot and the second pivot. The second pivot and the spring are inserted in the hollow inner tube. The hollow body and the hollow inner tube being configured such that a displacement of the lug along the longitudinal groove towards the second pivot gives rise to a displacement of the second pivot, in the hollow inner tube, towards the lug, the user can easily retract the two pivots by manual action on the lug, with the simple movement of a finger, and without a tool. In fact, since the lug is integral with the first pivot, this action by the user tends to bring the first and second pivots towards one another inside the hollow body.

13 Claims, 4 Drawing Sheets

(56) References Cited

U.S. PATENT DOCUMENTS 3,824,783 A * 7/1974 Nadeau ..... G04B 37/1493 368/282
3,939,534 A * 2/1976 Hayes ..... A44C 5/14 24/265 B
RE28,793 E * 5/1976 Bert ..... A44C 5/14 24/265 B
4,564,308 A * 1/1986 Ikegami ..... A44C 5/14 224/164
5,150,980 A * 9/1992 Lin ..... A47C 19/128 403/174
5,186,197 A * 2/1993 Lavine ..... A45B 9/02 135/25.1
5,483,505 A * 1/1996 Cartier ..... G04B 37/1493 368/282
5,991,978 A * 11/1999 Nussbaum ..... G04B 37/1493 24/265 B
6,450,179 B2 * 9/2002 Bengis ..... A45D 40/18 132/297
6,647,593 B2 * 11/2003 Iguchi ..... A44C 5/12 16/278
9,092,012 B2 * 7/2015 Dornhege ..... G04B 37/1493
9,314,071 B2 * 4/2016 Rivera ..... A44C 5/14
2007/0143970 A1 * 6/2007 Loetscher ..... G04B 37/1486 24/265 B
2013/0133158 A1 * 5/2013 Tran ..... A47B 95/02 16/422
2014/0250637 A1 * 9/2014 Stotz ..... A44C 5/14 24/265 B

OTHER PUBLICATIONS

Combined Chinese Office Action and Search Report dated Aug. 11, 2020, in Patent Application No. 201910323411.7 (with English translation), 13 pages.
Office Action dated Aug. 3, 2020 in corresponding Korean Patent Application No. 10-2019-0046316 (with English Translation), 6 pages.

* cited by examiner

BAR PROVIDED WITH TWO RETRACTABLE PIVOTS FOR SECURING A WRISTLET ON A WATCH

CROSS-REFERENCE TO RELATED APPLICATION

This application claims priority to European Patent Application No. 18168777.3 filed on Apr. 23, 2018, the entire disclosure of which is hereby incorporated herein by reference.

TECHNICAL FIELD OF THE INVENTION

The invention relates to a bar for securing a wristlet on a watch.

The invention also relates to a wristwatch comprising at least one such bar.

PRIOR ART

In the field of wristwatches, it is known to secure the wrist band, herein also referred to as a wristlet, on the watch by means of at least one spring bar. The spring bar is for example provided at its ends with two pins, herein also referred to as pivots, one of which is retractable in order to make it possible to separate the wristlet and the watch. The spring bar is inserted in a guide of the wristlet, and each pivot is designed to be introduced into a corresponding receptacle of a respective horn of the watch case, thus allowing the wristlet to be secured on the watch. A bar of this type is described for example in patent document CH 327838 A. The bar comprises a hollow body provided with a longitudinal groove; two pivots arranged in the hollow body; a spring disposed in the hollow body, supported between the pivots; and a lug. The two pivots can slide in a respective end of the hollow body. The spring pushes the pivots back in order to make their outer ends each penetrate in corresponding receptacles in the horns of the watch case. The lug is integral with one of the pivots, and extends through the longitudinal groove. The lug can slide along the longitudinal groove, allowing the pivot with which it is rendered integral to slide in the hollow body. The lug can be actuated by means of a specific tool, which a user introduces into an end of the wristlet, in order to displace the lug against the action of the spring and make the pivot exit from the corresponding receptacle of the horn of the watch case.

However, a disadvantage of a spring bar of this type is that it does not allow a user to be able to retract the two pivots easily with a single movement and without a tool. The use of a bar of this type is therefore restrictive for a user, and does not allow the user to separate the wristlet and the watch easily.

SUMMARY OF THE INVENTION

The objective of the invention is therefore to provide a bar for securing a wristlet on a watch, which allows a user to be able to retract the two pivots easily with a single movement, preferably with a single finger, and without a tool.

For this purpose, the invention relates to a bar for securing a wristlet on a watch, which comprises the characteristics described in the independent claim 1.

Particular forms of the bar are defined in the dependent claims 2 to 10.

An advantage of the bar according to the invention consists in the fact that it comprises a hollow inner tube which is arranged in the hollow body, and is configured to cooperate with the first pivot and the second pivot. The second pivot and the spring are inserted in the hollow inner tube. Thanks to the fact that the hollow body and the hollow inner tube are configured such that a displacement of the lug along the longitudinal groove towards the second pivot gives rise to a displacement of the second pivot, in the hollow inner tube, towards the lug, the user can easily retract the two pivots by manual action on the lug, with a single movement of a finger, and without a tool. In fact, since the lug is integral with the first pivot, this action by the user tends to bring the first and second pivots towards one another inside the hollow body.

A bar of this type according to the invention is also simple to produce and assemble.

Advantageously, on the second pivot side, the hollow inner tube comprises a first helical groove; on the second pivot side, the hollow body comprises an additional groove; and the shaft also comprises a tenon which is integral with the second pivot, the tenon extending through the first helical groove and through the additional groove in the hollow body, and being able to slide along the said first helical groove and the said additional groove; the hollow body and the hollow inner tube being configured such that a displacement of the lug along the longitudinal groove towards the tenon gives rise to a displacement of the tenon along the additional groove towards the lug, such as to bring the first and second pivots inside the hollow body.

According to a first embodiment of the invention, the additional groove in the hollow body is a second helical groove, the second helical groove having a length which is shorter than that of the first helical groove, the helicoid defined by the second helical groove having an angle of inclination, relative to a plane perpendicular to a longitudinal direction in which the hollow inner tube extends, which is smaller than an angle of inclination formed by the helicoid defined by the first helical groove relative to this same plane.

According to a second embodiment of the invention, the additional groove in the hollow body is a second longitudinal groove; and the hollow inner tube comprises, on the side opposite the second pivot, a second helical groove, the lug also extending through the second helical groove, and being able to slide along the second helical groove, the second helical groove having a length which is longer than that of the first helical groove, the helicoid defined by the second helical groove winding on the hollow inner tube in a direction opposite that of the helicoid defined by the first helical groove.

For this purpose, the invention also relates to a wristwatch comprising at least one securing bar as described above, and comprising the characteristics described in the dependent claim 11.

BRIEF DESCRIPTION OF THE FIGURES

The objectives, advantages and characteristics of the bar for securing a wristlet on a watch according to the invention, as well as the wristwatch comprising it, will become more apparent from the following description on the basis of at least one non-limiting embodiment illustrated by the drawings in which.

DETAILED DESCRIPTION OF THE INVENTION

Figure 1:
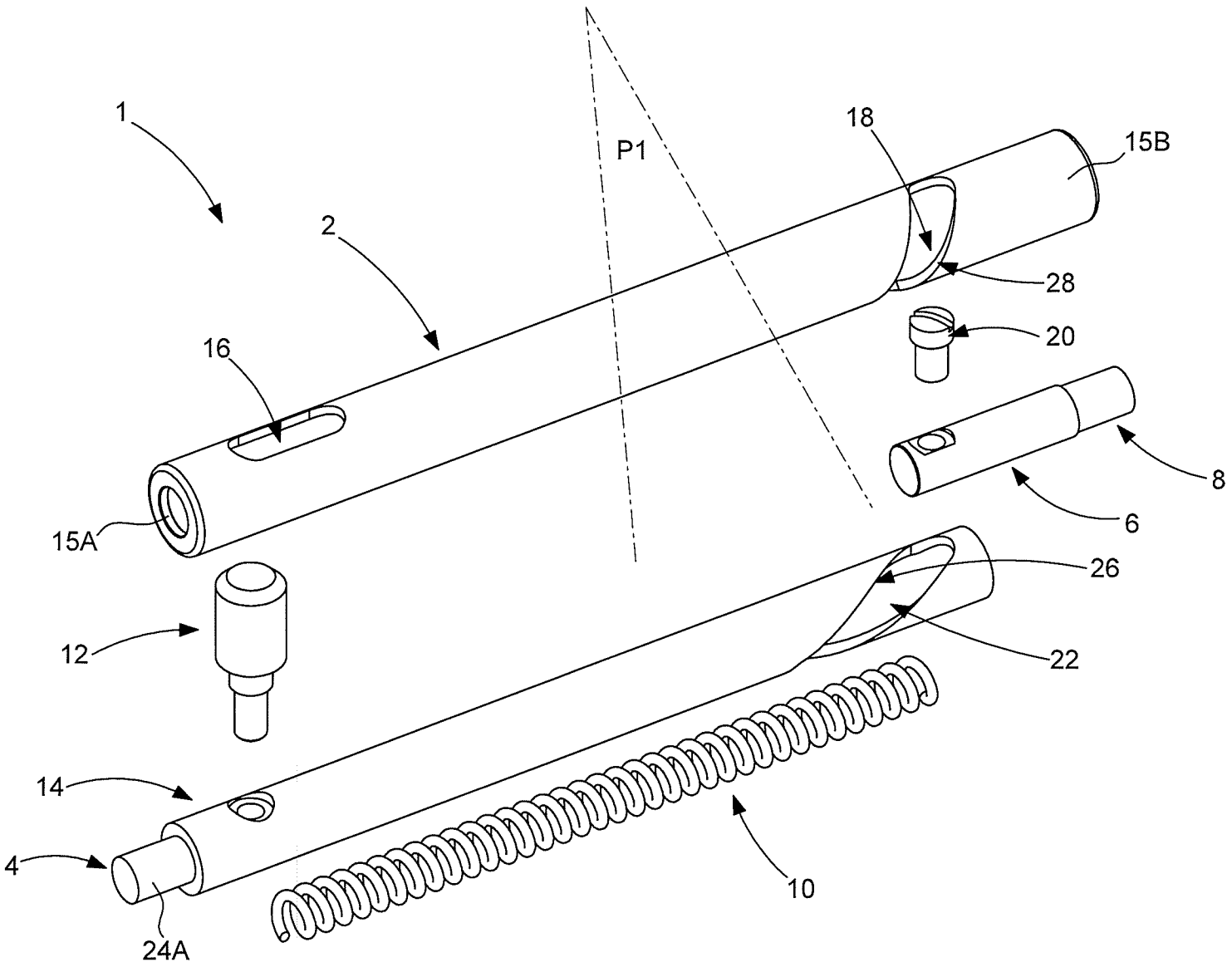
FIG. 1 is an exploded view in perspective of a bar for securing a wristlet on a watch according to a first embodiment of the invention.
Figure 2:
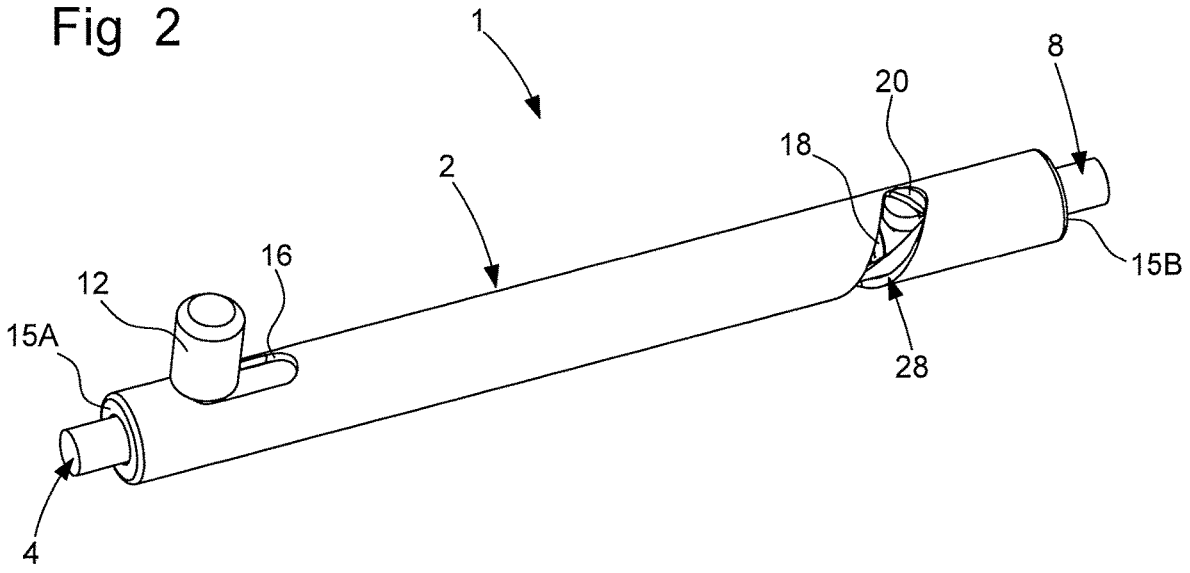
FIG. 2 is a view in perspective of the bar in FIG. 1, once assembled, in a position of rest of the bar.
Figure 3:
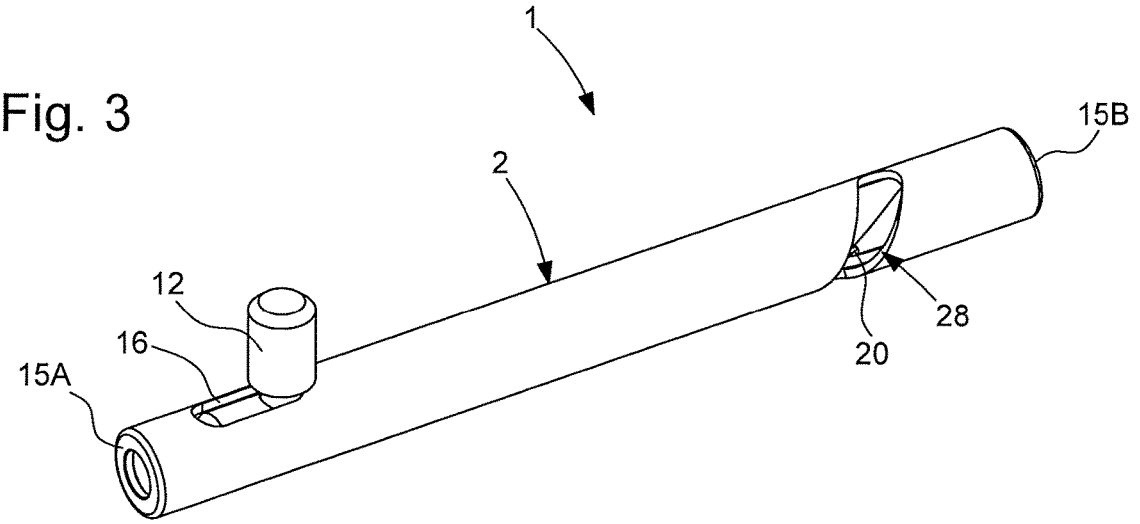
FIG. 3 is a view similar to that of FIG. 2, in a position of actuation of the bar.

FIGS. 1 to 3 represent a bar 1 for securing a wristlet on a watch according to a first embodiment of the invention. The wristlet and the watch are not represented in the figures for reasons of clarity. The wristlet is for example constituted by leather, metal, a ceramic material, or another material, without this being limiting within the context of the present invention.

The bar 1 comprises a hollow body 2, a first pivot 4 arranged in the hollow body 2, and a shaft 6 which is arranged in the hollow body 2, and is provided with a second pivot 8. The bar 1 is designed to be inserted in a guide of the wristlet, each of the first and second pivots 4, 8 being introduced into a corresponding receptacle of a respective horn of the watch case, thus allowing the wristlet to be secured on the watch. The bar 1 also comprises a spring 10, a lug 12 and a hollow inner tube 14 which is provided with a helical groove 22. The spring 10 and the hollow inner tube 14 are arranged in the hollow body 2.

Each of the first and second pivots 4, 8 can slide in a respective end 15A, 15B of the hollow body 2. On the first pivot 4 side, the hollow body 2 is provided with a longitudinal groove 16, the longitudinal direction being taken as the largest direction in which the hollow body 2 extends. The longitudinal groove 16 forms an opening in the surface of the hollow body 2. On the second pivot 8 side, the hollow body 2 also comprises an additional groove 18. In the particular embodiment illustrated in FIGS. 1 to 3, the additional groove 18 is a helical groove. The helical groove 18 forms an opening in the surface of the hollow body 2. The helical groove 18 in the hollow body 2 has a length which is shorter than that of the helical groove 22 in the hollow inner tube 14. In addition, the helicoid which is defined by the helical groove 18 in the hollow body 2 has an angle of inclination, relative to a plane P1 perpendicular to the longitudinal direction in which the hollow inner tube 14 extends, which is smaller than an angle of inclination formed by the helicoid defined by the helical groove 22 in the hollow inner tube 14 relative to the plane P1. Preferably, as illustrated in FIG. 1, the helicoid which is defined by the helical groove 22 is wound on the hollow inner tube 14 in the same direction as the helicoid defined by the helical groove 18 in the hollow body 2.

The shaft 6 also comprises a tenon 20 which is integral with the second pivot 8. The tenon 20 extends from an outer surface of the second pivot 8, substantially perpendicularly to the longitudinal direction in which the second pivot 8 extends. The second pivot 8 and the spring 10 are inserted in the hollow inner tube 14. The spring 10 is retained supported between the first and second pivots 4, 8. As illustrated in FIG. 1, the spring 10 is for example a coil spring.

The lug 12 extends from an outer surface of the hollow inner tube 14, substantially perpendicularly to the longitudinal direction in which the hollow inner tube 14 extends. The lug 12 extends through the longitudinal groove 16, and can slide along this longitudinal groove 16. The lug 12 is designed to be manipulated by a user of the watch, and thus constitutes a unit for actuation of the bar 1, permitting the retraction of the first and second pivots 4, 8, as will be described in detail hereinafter.

The hollow inner tube 14 is configured to co-operate with the first pivot 4 and with the second pivot 8. More specifically, the hollow inner tube 14 comprises a helical groove 22 on the second pivot 8 side. The helical groove 22 forms an opening in the surface of the hollow inner tube 14. The tenon 20, which is integral with the second pivot 8, extends both through the helical groove 22 in the hollow inner tube 14, and through the helical groove 18 in the hollow body 2, and can slide along these two grooves 18, 22. In addition, as illustrated in FIG. 1, the first pivot 4, the lug 12, and the hollow inner tube 14 are preferably formed in a single piece of material. The first pivot 4 forms an end 24A of the hollow inner tube 14, situated opposite the second pivot 8 relative to the spring 10.

The hollow body 2 and the hollow inner tube 14 are thus configured such that a displacement of the lug 12 along the longitudinal groove 16 towards the second pivot 8 gives rise to a displacement of the second pivot 8 in the hollow inner tube 14 towards the lug 12. This makes it possible to bring the first and second pivots 4, 8 towards one another inside the hollow body 2, as shown in FIGS. 2 and 3. More specifically, the hollow body 2 and the hollow inner tube 14 are configured such that a displacement of the lug 12 along the longitudinal groove 16 towards the tenon 20 gives rise to a displacement of the tenon 20 along the helical groove 18 towards the lug 12. Since the lug 12 is integral with the first pivot 4 and the tenon 20 is integral with the second pivot 8, this gives rise to bringing towards one another of the first and second pivots 4, 8 inside the hollow body 2. The lug 12 thus constitutes a maneuvering unit for a user of the watch, in order to retract the first and second pivots 4, 8 against the action of the spring 10.

The operation of the bar 1 according to the first embodiment of the invention will now be described with reference to FIGS. 2 and 3.

FIG. 2 represents the bar 1 in the position of rest, i.e. with the first and second pivots 4, 8 deployed on the exterior of the hollow body 2. In fact, the spring 10 pushes the first and second pivots 4, 8 in opposite directions, via the hollow inner tube 14 on the one hand and the shaft 6 on the other hand. This allows the first and second pivots 4, 8 to be introduced into corresponding receptacles of the horns of the watch case, and thus to secure the wristlet on the watch.

When a user of the watch pushes the lug 12 with a finger in the direction of the centre of the bar 1, in addition to the retraction of the first pivot 4, an inner helical surface 26 of the helical groove 22 in the hollow inner tube 14, shown in FIG. 1, pushes the tenon 20, and therefore the second pivot 8, towards the exterior of the hollow body 2. The tenon 20 then meets an outer helical surface 28 of the helical groove 18 in the hollow body 2, shown in FIG. 1, which, because of its inclination, tends to make the shaft 6 pivot, and therefore make the second pivot 8 pivot around itself, and, by this means, displaces it longitudinally towards the centre of the bar 1. As shown in FIG. 3, this movement thus retracts the second pivot 8 and then releases the bar 1 from its location between the horns of the watch case.

When the user of the watch releases the lug 12, the spring 10 exerts a force which tends to push back the hollow inner tube 14 and the shaft 6, and thus the first and second pivots 4, 8, in opposite directions. The position of rest of the bar 1 is then regained.

A bar 30 for securing a wristlet on a watch according to a second embodiment of the invention will now be described with reference to FIGS. 4 to 6. The wristlet and the watch are not represented in the figures for reasons of clarity. The wristlet is for example constituted by leather, metal, a ceramic material, or another material, without this being limiting within the context of the present invention.

The bar 30 comprises a hollow body 32, a first shaft 33 which is arranged in the hollow body 32 and is provided with a first pivot 34, and a second shaft 36 which is arranged in the hollow body 32 and provided with a second pivot 38. The bar 30 is designed to be inserted in a guide of the wristlet, each of the first and second pivots 34, 38 being introduced into a corresponding receptacle of a respective horn of the watch case, thus allowing the wristlet to be secured on the watch. The bar 30 additionally comprises a spring 40 and a hollow inner tube 44. The spring 40 and the hollow inner tube 44 are arranged in the hollow body 32.

Each of the first and second pivots 34, 38 can slide in a respective end 15A, 15B of the hollow body 32. The hollow body 32 is provided on the first pivot 34 side with a first longitudinal groove 46, the longitudinal direction being taken as the largest direction in which the hollow body 32 extends. The first longitudinal groove 46 forms an opening in the surface of the hollow body 32. On the second pivot 38 side, the hollow body 32 also comprises an additional groove 48. In the particular embodiment illustrated in FIGS. 4 to 6, the additional groove 48 is a longitudinal groove, thus forming a second longitudinal groove 48 for the hollow body 32. The second longitudinal groove 48 forms an opening in the surface of the hollow body 32. Preferably, as illustrated in FIGS. 4 to 6, the second longitudinal groove 48 in the hollow body 32 has a length shorter than that of the first longitudinal groove 46.

The first shaft 33 also comprises a lug 52 which is integral with the first pivot 34. The lug 52 extends from an outer surface of the first pivot 34, substantially perpendicularly to the longitudinal direction in which the first pivot 34 extends. The lug 52 is designed to be manipulated by a user of the watch, and thus constitutes a unit for actuation of the bar 30, permitting the retraction of the first and second pivots 34, 38, as will be described in detail hereinafter.

The second shaft 36 also comprises a tenon 54 which is integral with the second pivot 38. The tenon 54 extends from an outer surface of the second pivot 38, substantially perpendicularly to the longitudinal direction in which the second pivot 38 extends. The first pivot 34, the second pivot 38 and the spring 40 are inserted in the hollow inner tube 44. The spring 40 is retained supported between the first and second pivots 34, 38. As illustrated in FIG. 4, the spring 10 is for example a coil spring.

The hollow inner tube 44 is configured to cooperate with the first pivot 34 and with the second pivot 38. More specifically, on the first pivot 34 side, the hollow inner tube 44 comprises a first helical groove 56, and, on the second pivot 38 side, it comprises a second helical groove 58. The first and second helical grooves 56, 58 form respective openings in the surface of the hollow inner tube 44. The first helical groove 56 has a length which is longer than that of the second helical groove 58. The helicoid defined by the first helical groove 56 is wound on the hollow inner tube 44 in a direction opposite that of the helicoid defined by the second helical groove 58. Preferably, the helicoid defined by the first helical groove 56 has an angle of inclination relative to a plane P1 perpendicular to the longitudinal direction in which the hollow inner tube 44 extends, the absolute value of which is different from, for example greater than, the absolute value of an angle of inclination formed by the helicoid defined by the second helical groove 58 relative to the plane P1. The lug 52, which is integral with the first pivot 34, extends both through the first helical groove 56 in the hollow inner tube 44, and through the first longitudinal groove 46 in the hollow body 32, and can slide along these two grooves 46, 56. The tenon 54, which is integral with the second pivot 38, extends both through the second helical groove 58 in the hollow inner tube 44, and through the second longitudinal groove 48 in the hollow body 32, and can slide along these two grooves 48, 58.

The hollow inner tube 44 can turn around its longitudinal direction inside the hollow body 32.

The hollow body 32 and the hollow inner tube 44 are thus configured such that a displacement of the lug 52 along the first longitudinal groove 56 towards the second pivot 38 gives rise to a displacement of the second pivot 38 in the hollow inner tube 44, towards the lug 52. This makes it possible to bring the first and second pivots 34, 38 towards one another inside the hollow body 32, as shown in FIGS. 5 and 6. More specifically, the hollow body 32 and the hollow inner tube 44 are configured such that a displacement of the lug 52 along the first longitudinal groove 46 towards the tenon 54 gives rise to a displacement of the tenon 54 along the second longitudinal groove 48 towards the lug 52. Since the lug 52 is integral with the first pivot 34, and the tenon 54 is integral with the second pivot 38, this gives rise to bringing towards one another of the first and second pivots 34, 38 inside the hollow body 32. The lug 52 thus constitutes a maneuvering unit for a user of the watch, in order to retract the first and second pivots 34, 38 against the action of the spring 40.

The operation of the bar 30 according to the second embodiment of the invention will now be described with reference to FIGS. 5 and 6.

Figure 5:
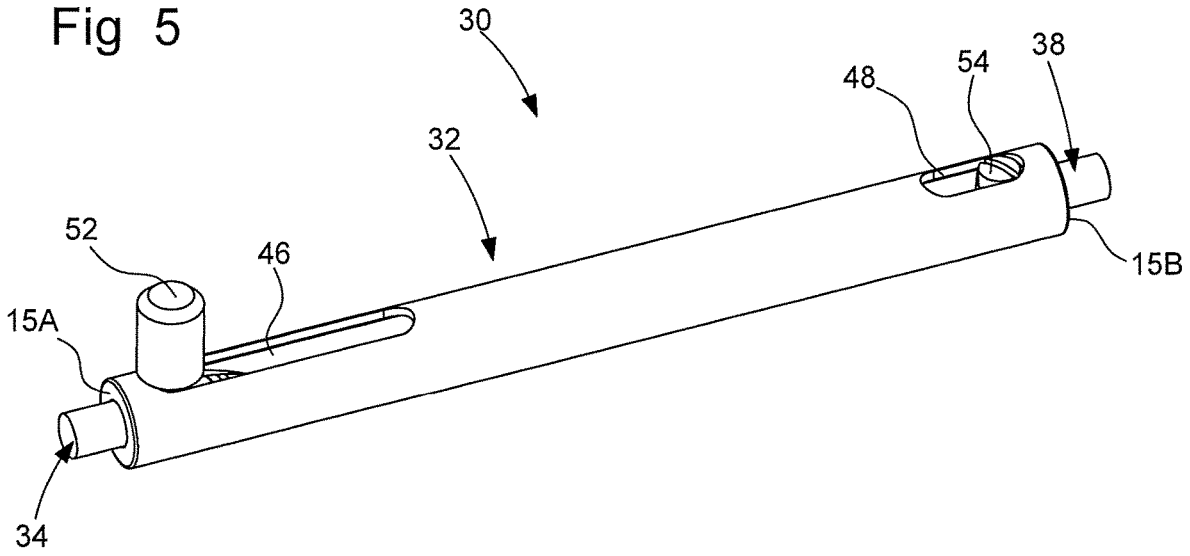
FIG. 5 is a view in perspective of the bar in FIG. 4, once assembled, in a position of rest of the bar.
Figure 6:
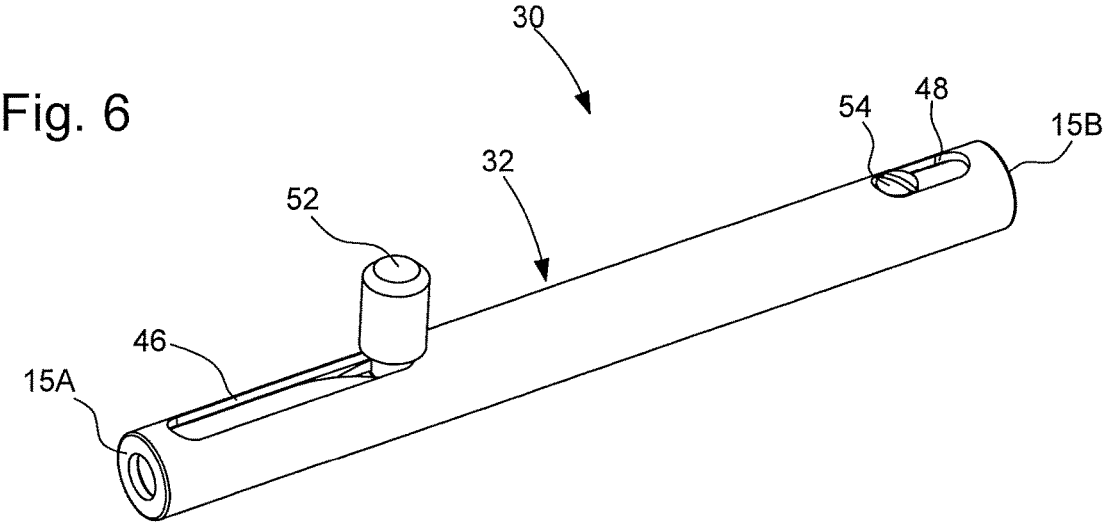
FIG. 6 is a view similar to that of FIG. 5, in a position of actuation of the bar.

FIG. 5 represents the bar 30 in the position of rest, i.e. with the first and second pivots 34, 38 deployed on the exterior of the hollow body 32. In fact, the spring 40 pushes the first and second pivots 34, 38 in opposite directions, via the first and second shafts 33, 36. This allows the first and second pivots 34, 38 to be introduced into corresponding receptacles of the horns of the watch case, and thus to secure the wristlet to the watch.

Figure 4:
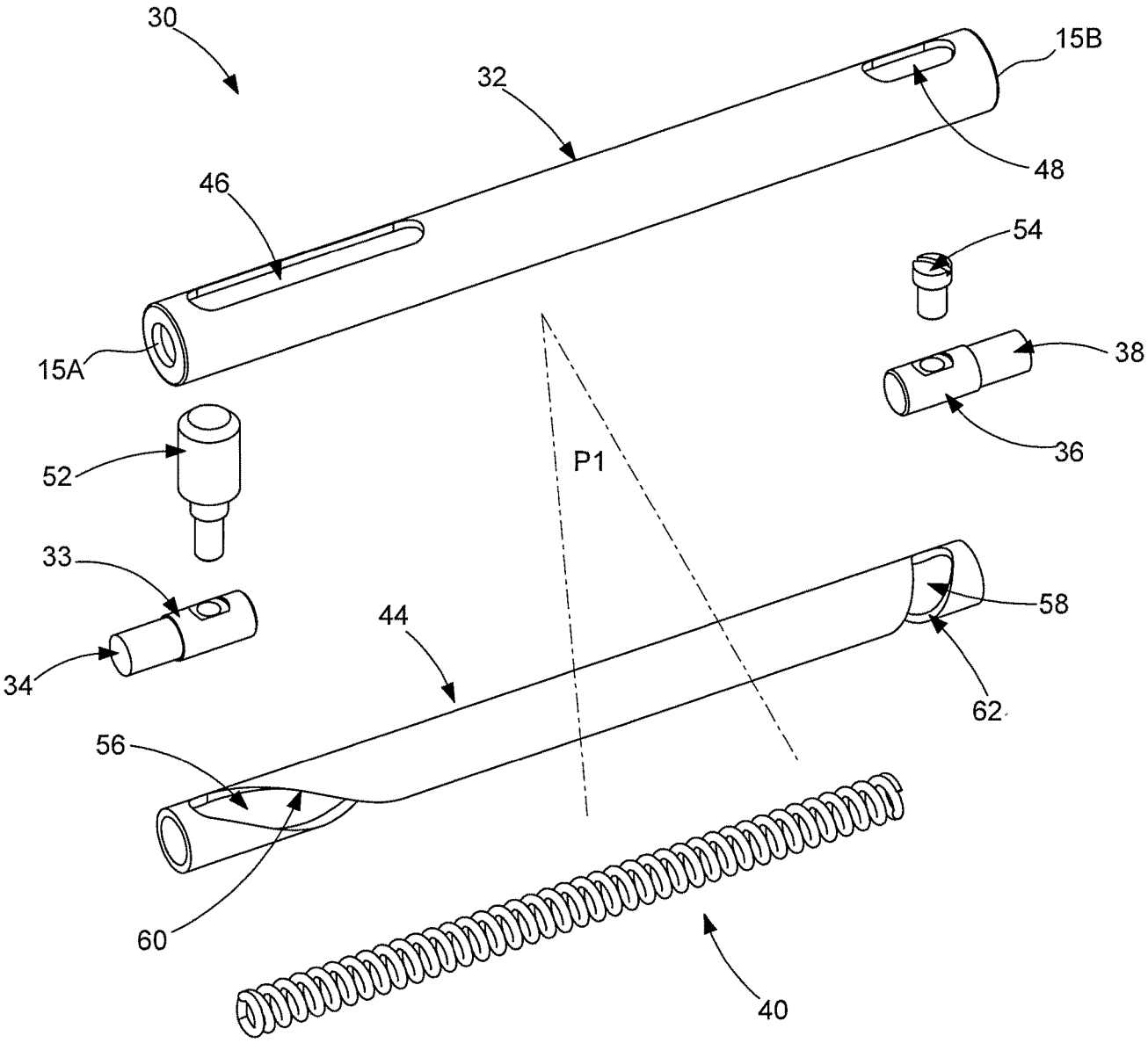
FIG. 4 is an exploded view in perspective of a bar for securing a wristlet on a watch according to a second embodiment of the invention.

When a user of the watch pushes the lug 52 with a finger in the direction of the centre of the bar 30, in addition to the retraction of the first pivot 34, the rubbing of the base of the lug 52 against an inner helical surface 60 of the first helical groove 56, shown in FIG. 4, forces the hollow inner tube 44 to turn around its longitudinal direction inside the hollow body 32, and in fact the first shaft 33 can not turn because of the first longitudinal groove 46 in the hollow body 32. The rotation of the hollow inner tube 44 inside the hollow body 32 then gives rise to rubbing between an outer helical surface 62 of the second helical groove 58, shown in FIG. 4, and the tenon 54. This rubbing causes the tenon 54 to be displaced longitudinally along the second longitudinal groove 48 in the hollow body 32, towards the centre of the bar 30. As can be seen in FIG. 6, this movement thus retracts the second pivot 38, and then releases the bar 30 from its location between the horns of the watch case.

When the user of the watch releases the lug 52, the spring 40 exerts a force which tends to push the first and second shafts 33, 36 back, and therefore the first and second pivots 34, 38, in opposite directions. The position of rest of the bar 30 is then regained.

The invention claimed is:

1. A bar for securing a wristlet on a watch, comprising a hollow body provided with a longitudinal groove; a first pivot arranged in the hollow body; a shaft arranged in the hollow body and provided with a second pivot, each of the first and second pivots being able to slide in a respective end of the hollow body and being designed to be introduced into a corresponding receptacle of a respective horn of a watch case; a spring disposed in the hollow body, supported between the first and second pivots; and a lug which extends through the longitudinal groove and can slide along the longitudinal groove, said lug being integral with the first pivot and constituting a manoeuvring unit in order to displace the first pivot against the action of the spring, wherein:

the bar additionally comprises a hollow inner tube arranged in the hollow body, the second pivot and the spring being inserted in the hollow inner tube;

the hollow inner tube is configured to co-operate with the first pivot and with the second pivot; and the hollow body and the hollow inner tube are configured such that a displacement of the lug along the longitudinal groove towards the second pivot gives rise to a displacement of the second pivot, in the hollow inner tube, towards the lug, such as to bring the first and second pivots towards one another inside the hollow body, the lug constituting a manoeuvring unit in order to displace the first and second pivots against the action of the spring, the hollow inner tube comprises a first helical groove on the second pivot side:

the hollow body comprises an additional groove on the second pivot side; and the shaft additionally comprises a tenon which is integral with the second pivot, the tenon extending through the first helical groove and through the additional groove in the hollow body, and being able to slide along said first helical groove and said additional groove;

the hollow body and the hollow inner tube being configured such that a displacement of the lug along the longitudinal groove towards the tenon gives rise to a displacement of the tenon along the additional groove towards the lug, such as to bring the first and second pivots towards one another inside the hollow body.

2. The bar according to claim 1, wherein the additional groove in the hollow body is a second helical groove, the second helical groove having a length which is shorter than that of the first helical groove, the helicoid defined by the second helical groove having an angle of inclination, relative to a plane perpendicular to a longitudinal direction wherein the hollow inner tube extends, which is smaller than an angle of inclination formed by the helicoid defined by the first helical groove relative to this same plane.

3. The bar according to claim 2, wherein the first pivot, the lug and the hollow inner tube are formed in a single piece of material, the first pivot forming an end of the hollow inner tube, situated opposite the second pivot relative to the spring.

4. The bar according to claim 2, wherein the helicoid defined by the first helical groove is wound on the hollow inner tube in the same direction as the helicoid defined by the second helical groove on the hollow body.

5. The bar according to claim 3, wherein the helicoid defined by the first helical groove is wound on the hollow inner tube in the same direction as the helicoid defined by the second helical groove on the hollow body.

6. The bar according to claim 1, wherein the additional groove in the hollow body is a second longitudinal groove; and wherein the hollow inner tube comprises a second helical groove on the side opposite the second pivot, the lug also extending through the second helical groove and being able to slide along the second helical groove, the second helical groove having a length which is longer than that of the first helical groove, the helicoid defined by the second helical groove being wound on the hollow inner tube in a direction opposite that of the helicoid defined by the first helical groove.

7. The bar according to claim 6, further comprising an additional shaft arranged in the hollow body, said additional shaft comprising the first pivot and the lug, the first pivot extending in the hollow inner tube, opposite the second pivot relative to the spring.

8. The bar according to claim 6, wherein the second longitudinal groove has a length which is shorter than that of the first longitudinal groove.

9. The bar according to claim 7, wherein the second longitudinal groove has a length which is shorter than that of the first longitudinal groove.

10. The bar according to claim 6, wherein the hollow inner tube can turn around its longitudinal direction inside the hollow body.

11. The bar according to claim 1, wherein the spring is a coil spring.

12. A wristwatch comprising watch part, a wristlet and a bar securing the wristlet to the watch part, wherein the bar comprises:

a hollow body provided with a longitudinal groove: a first pivot arranged in the hollow body; a shaft arranged in the hollow body and provided with a second pivot, each of the first and second pivots being able to slide in a respective end of the hollow body and being designed to be introduced into a corresponding receptacle of a respective horn of a watch case; a spring disposed in the hollow body, supported between the first and second pivots; and a lug which extends through the longitudinal groove and can slide along the longitudinal groove. said lug being integral with the first pivot and constituting a manoeuvring unit in order to displace the first pivot against the action of the spring, wherein:

the bar additionally comprises a hollow inner tube arranged in the hollow body, the second pivot and the spring being inserted in the hollow inner tube:

the hollow inner tube is configured to co-operate with the first pivot and with the second pivot; and the hollow body and the hollow inner tube are configured such that a displacement of the lug along the longitudinal groove towards the second pivot gives rise to a displacement of the second pivot, in the hollow inner tube, towards the lug, such as to bring the first and second pivots towards one another inside the hollow body, the lug constituting a manoeuvring unit in order to displace the first and second pivots against the action of the spring, the hollow inner tube comprises a first helical groove on the second pivot side;

the hollow body comprises an additional groove on the second pivot side; and the shaft additionally comprises a tenon which is integral with the second pivot, the tenon extending through the first helical groove and through the additional groove in the hollow body, and being able to slide along said first helical groove and said additional groove;

the hollow body and the hollow inner tube being configured such that a displacement of the lug along the longitudinal groove towards the tenon gives rise to a displacement of the tenon along the additional groove towards the lug, such as to bring the first and second pivots towards one another inside the hollow body.

13. The wristwatch according to claim 12, wherein the additional groove in the hollow body is a second longitudinal groove; and wherein the hollow inner tube comprises a second helical groove on the side opposite the second pivot, the lug also extending through the second helical groove and being able to slide along the second helical groove, the second helical groove having a length which is longer than that of the first helical groove, the helicoid defined by the second helical groove being wound on the hollow inner tube in a direction opposite that of the helicoid defined by the first helical groove.

* * * * *